US008066397B2

(12) United States Patent
Lin

(10) Patent No.: US 8,066,397 B2
(45) Date of Patent: Nov. 29, 2011

(54) LIGHT PEN

(75) Inventor: Chih-Hsiung Lin, Sindian (TW)

(73) Assignee: Era Optoelectronics Inc., New Taipei (TW)

( * ) Notice: Subject to any disclaimer, the term of this patent is extended or adjusted under 35 U.S.C. 154(b) by 0 days.

(21) Appl. No.: 12/007,577

(22) Filed: Jan. 11, 2008

(65) Prior Publication Data

US 2011/0090668 A1 Apr. 21, 2011

(30) Foreign Application Priority Data

Jan. 15, 2007 (TW) ..... 96200773 U

(51) Int. Cl.
*B43K 29/10* (2006.01)
*G09G 3/37* (2006.01)

(52) U.S. Cl. ..... 362/118; 362/579; 345/180; 345/183

(58) Field of Classification Search ..... 362/119, 362/120, 194, 195, 200, 202, 208, 394; 345/180, 345/183

See application file for complete search history.

(56) References Cited

U.S. PATENT DOCUMENTS

| | | | | |
|---|---|---|---|---|
| 3,749,932 | A * | 7/1973 | Jones | 307/112 |
| 4,263,592 | A * | 4/1981 | Takahashi et al. | 345/180 |
| 4,677,428 | A * | 6/1987 | Bartholow | 345/180 |
| 6,265,984 | B1 * | 7/2001 | Molinaroli | 340/815.4 |
| 6,572,019 | B1 * | 6/2003 | Rando et al. | 235/472.01 |
| 7,239,306 | B2 * | 7/2007 | Fahraeus et al. | 345/179 |

* cited by examiner

*Primary Examiner* — Hargobind S Sawhney

(57) ABSTRACT

First and second magnets of a light pen according to the present invention are used for replacing a conventional spring to be a switch structure of the light pen. Whereby, the elastic fatigue problem is not yielded, the switch structure is enabled to be more durable and dependable and can be used as a switch structure for a light pen whose stroke between two electric contact points from a separation state to a contact state is shorter.

11 Claims, 2 Drawing Sheets

LIGHT PEN

BACKGROUND OF THE INVENTION

1. Field of the Invention

The present invention relates to a light pen, and more particularly to a light pen adapted to provide an input device for processing an input operation on an operation surface 2. Description of Related Art Taiwan Patent No. 479190 entitled as "Data Input Device" discloses a movable luminescence device, which can be operated and moved by a user and emit at least two color lights; and a camera connected to a computer, which can capture and shoot light emitted from the movable luminescence device, and judge the color of the light and process and transfer the captured moving track of the light points of the movable luminescence device to a XY coordinate data so as to allow the computer device to process the index inputting function; the movable luminescence device is manufactured to be a pen shape, the photodiode is installed on a pen nib portion.

A spring in the movable luminescence device is used for providing switching elasticity; this might yield elastic fatigue problem relatively. Besides, because the spring with longer deformation can then have a larger spring force, when a distance between two electric contact points is too small and a stroke between the both from a separation state to a contact state is too short, the spring can then not be used as a switch structure.

SUMMARY OF THE INVENTION

For improving a switch structure of a light pen to allow the switch structure to be more durable, the present invention is proposed.

The main object of the present invention is to provide a light pen, replacing a spring with two magnets to allow a switch structure of the light pen to be more durable and dependable.

Another object of the present invention is to provide a light pen, capable of being used as a switch structure for a shorter stroke between two electric contact points from a separation state to a contact state.

For attaining to the objects mentioned above, the present invention proposes a light pen allowing a switch structure thereof to be more durable and dependable and have a shorter stroke, comprises:

a pen shell, being tubular;

a luminescence element, movably connected with the shell and having a first pin and a second pin;

a first magnet, movably installed in the pen shell; and a second magnet, fixed in the pen shell and installed above the first magnet;

wherein, the pen shell is used for accepting a battery, two adjacent sides of the first and the second magnets are respectively provided with different magnetism; the first and the second magnets are always separated and approach each other only if an external force is acted on them. The first pin and the second pin of the luminescence element are ordinarily respectively do not turn on a circuit constituted by a first terminal and a second terminal of the battery to allow the luminescence element not to radiate; when the first and the second magnets are near, the first pin and the second pin of the luminescence element respectively turn on the circuit constituted by the first terminal and the second terminal of the battery to allow the luminescence element to radiate; whereby, the switch structure of the light pen is enabled not to yield elastic fatigue and have a shorter stroke.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
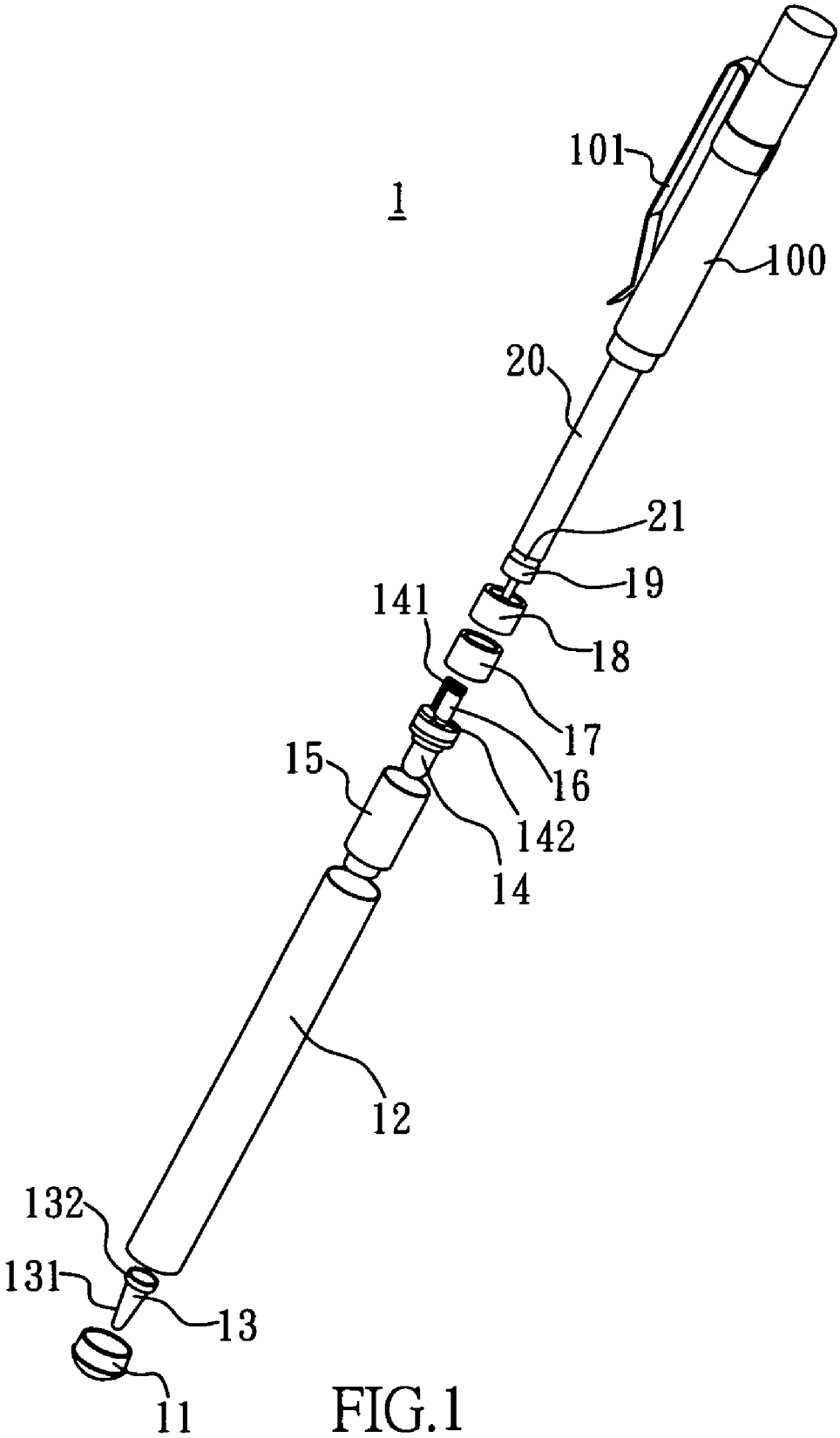
FIG. 1 is a schematic view, showing a light pen of a preferred embodiment according to the present invention.
Figure 2:
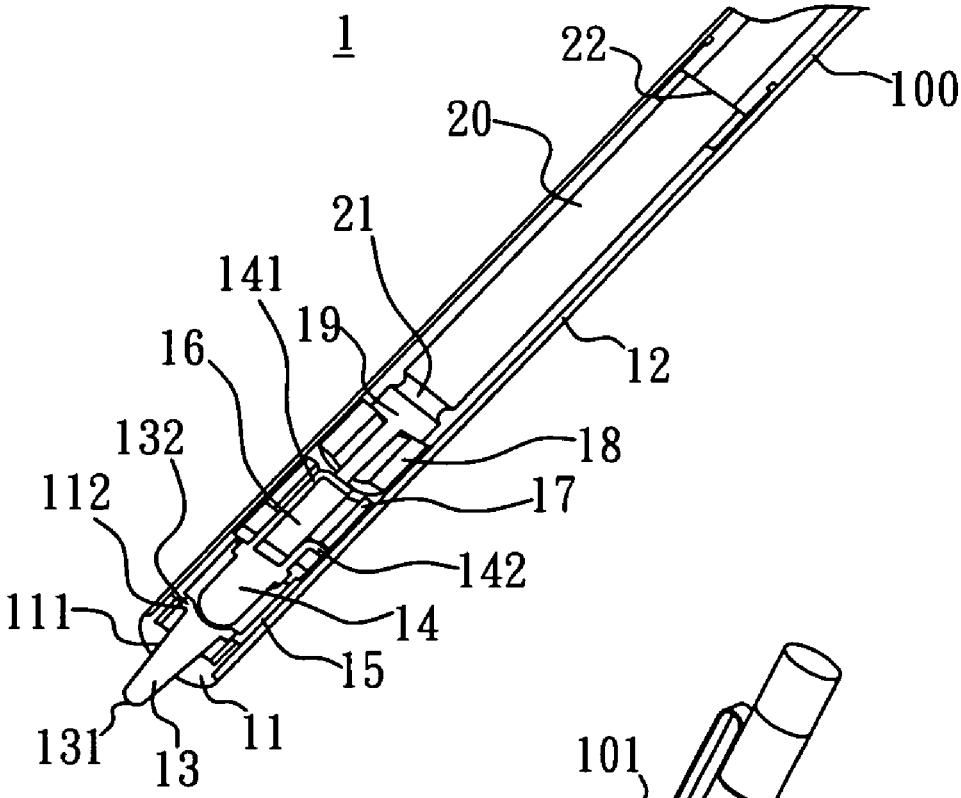
FIG. 2 is a partly cross sectional view, showing a light pen of a preferred embodiment according to the present invention.
Figure 3:
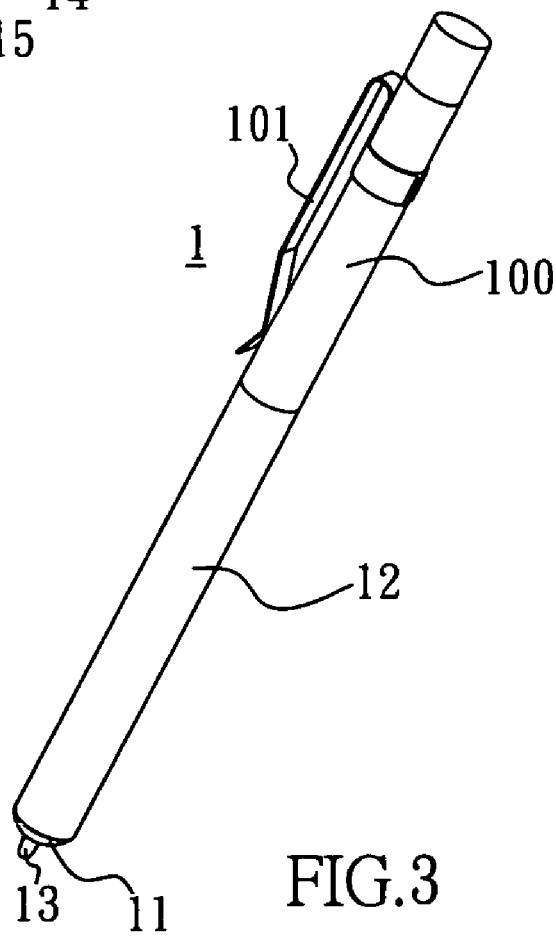
FIG. 3 is a perspective view, showing a light pen of a preferred embodiment according to the present invention.

Please refer to FIGS. 1, 2 and 3. A light pen 1 of the present invention is adapted to allow a switch structure to be more durable and dependable and have a shorter stroke, comprises a lower shell 11, a middle shell 12, a light guiding bar 13, a luminescence element, a lower cover 15, an insulation isolator 16, a first magnet 17, a second magnet 18, a conducting pin 19, a battery 20 and a upper shell 100: the lower shell 11 is tubular and a lower channel 111 of an inner part thereof is narrower than a upper channel 112 thereof;

the middle shell 12 is tubular and a lower end thereof is combined with the lower shell 11;

the light guiding bar 13 is used for guiding light, engaged in the lower shell 11; a front end 131 thereof is extended out of the lower shell 11, and a rear end thereof 132 is thicker and is lodged in the upper channel 112 of the lower shell 11;

the luminescence element, such as photodiode 14, has a first pin 141 and a second pin 142 in which the first pin 141 is longer than the second pin 142 and a bottom of the luminescence element is propped against the light guiding bar 13.

the lower cover 15 is installed in the middle shell 12 and put around an outer rim of a lower end of the photodiode 14;

the insulation isolator 16 is provided with channels respectively engaged with the first and the second pins 141 and 142 to allow the first and the second pins 141 and 142 not to contact with each other;

the first magnet 17 is annular, movably installed inside the middle shell 12, engaged with a outside portion of the first pin 141 and positioned above the second pin 142;

the second magnet 18 is annular, fixed inside the middle shell 12, positioned above the first magnet 17; two adjacent sides of the first and the second magnets 17 and 18 are provided with different magnetism to allow the both to be separated always and approach each other when an outside force is exerted on them;

a lower end of the conducting tip 19 is passed through a lower end of the second magnet 18;

the battery 20 is installed inside the middle shell 12 provided with first and second terminals 21 and 22 in which the first terminal 21 contacts with a upper end of the conducting tip 19; and the upper shell 100 is combined with a upper end of the middle shell 12 and a clip 101 used for being clipped on a pocket of a user is installed on an outside portion of the upper shell 100.

When the light pen of the present invention is assembled, the second pin 142 of the photodiode 14 is electrically connected to the second terminal 22 of the battery 20 through a leading wire or the metalwork upper shell 100 and middle shell 12. When a user causes the light guiding bar 13 to touch an operation surface and the middle shell 12 to move downward to enable the conducting tip 19 to touch the first pin 141 of the photodiode 14 to turn on a circuit constituted by the photodiode 14 and the battery 20, the photodiode 14 is then allowed to radiate and beams are emitted through the light guiding bar 13. When the user does not allow the middle shell 12 to mover downward, the conducting tip 19 and the first pin 141 of the photodiode 14 is not allowed to contact with each other and the circuit is not turned on to cause the photodiode 14 not to radiate through a repulsive force between the first and the second magnets 17 and 18.

A pen shell of the present invention can be formed by combining the metalwork or plastic lower shell 11, middle shell 12 and upper shell 100, and also be formed by integrating the lower shell 11 with the middle shell 12.

The photodiode 14 of the present invention can also be a laser diode. The light guiding bar 13 can also comprise a light guiding element capable of emitting a cross type laser beam or a particular type beam to enable the light pen 1 to emit a beam with a particular type so as to increase the recognizability of the input device on whether a user use the light pen to process an input operation.

The present invention is to utilize the first and the second magnets 17 and 18 to replace the conventional spring to be the switch structure of the light pen 1; it will not generate an elastic fatigue problem and enables the switch structure to be more durable and dependable and can be used as a switch structure for a light pen whose stroke between two electric contact points from a separation state to a contact state is shorter.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A light pen, adapted to allow a switch structure thereof to be more durable and dependable and have a shorter stroke, comprising:

a pen shell being tubular;

a luminescence element movably combined with said pen shell and provided with first and second pins;

a first magnet movably installed in said pen shell;

a second magnet fixed in said pen shell and positioned above said first magnet;

an insulation isolator respectively engaged to said first and said second pins to allow said first and said second pins not to contact with each other;

wherein, said pen shell is used for accepting a battery; two adjacent sides of said first and said second magnets have different magnetism, said first and said second magnets are always separated, and approach each other once an external force is exerted thereon; said first pin and said second pin of the luminescence element ordinarily respectively do not turn on a circuit which is constituted by a first terminal and a second terminal of the battery to allow said luminescence element not to radiate; when said first and said second magnets are near, said first pin and said second pin of said luminescence element respectively turn on said circuit constituted by said first terminal and said second terminal of said battery to allow said luminescence element to radiate;

wherein a light guiding element is further installed in said pen shell and used for guiding light; a front end of said light guiding element is extended out of a lower end of said pen shell, a rear end thereof is thicker, and is lodged in said pen shell; said luminescence element is movably installed in said pen shell, a bottom thereof is positioned above said light guiding element;

wherein said first pin is longer than said second pin; said first magnet is annular and disposed around an outside portion of said first pin and above said second pin.

2. The light pen according to claim 1, wherein said pen shell is constituted by a lower shell, a middle shell and an upper shell.

3. The light pen according to claim 1, wherein said second magnet is annular; a upper end of a conducting tip is used for electrically connected to a first terminal of said battery, and a lower end thereof is passed through a lower end of said second magnet; when said first and said second magnets approach each other, said conducting tip touches said second pin to turn on said circuit.

4. The light pen according to claim 3, wherein said pen shell is made from metal and used for allowing said second pin of said luminescence element to be electrically connected to said second terminal of said battery through said pen shell.

5. The light pen according to claim 4, wherein a lower cover is accepted in said pen shell; said lower cover is engaged with an outer rim of a lower end of said luminescence element.

6. The light pen according to claim 3, further comprising a leading wire used for allowing said pin of said luminescence element to electrically connected to said second terminal of said battery through said leading wire.

7. The light pen according to claim 6, wherein a lower cover is accepted in said pen shell; said lower cover is engaged with an outer rim of a lower end of said luminescence element.

8. The light pen according to claim 7 wherein said luminescence element is a photodiode.

9. The light pen according to claim 8, wherein said photodiode is a laser diode.

10. The light pen according to claim 9, wherein said light guiding element is a light guiding element emitting a cross type laser beam or a particular type beam.

11. The light pen according to claim 10, wherein said pen shell is formed by combining said lower shell, said middle shell and said upper shell.

* * * * *